United States Patent [19]

Barrett

[11] 3,937,997

[45] Feb. 10, 1976

[54] CATHODE-RAY TUBE SIGNAL GENERATOR HAVING RESISTANCE CONFIGURATED ELECTRON RECEPTOR

[76] Inventor: Dene Barrett, 15608 Delcombre Ave., Paramount, Calif. 90723

[22] Filed: Sept. 13, 1974

[21] Appl. No.: 505,768

[52] U.S. Cl. ..... 313/418; 313/329; 313/419; 315/8.5; 328/64

[51] Int. Cl.[2] ..... H01J 31/02

[58] Field of Search ..... 313/418, 419, 473, 311, 313/329; 315/3, 8.5, 58; 321/DIG. 1; 328/13, 14, 64, 178

[56] References Cited

UNITED STATES PATENTS

| | | | |
|---|---|---|---|
| 1,946,223 | 2/1934 | Mason | 313/419 X |
| 2,365,476 | 12/1944 | Knoop, Jr. et al. | 313/419 X |
| 2,374,666 | 5/1945 | Cunniff | 328/64 X |
| 2,728,854 | 12/1955 | Ross | 313/418 X |
| 3,157,811 | 11/1964 | Stone, Jr. | 313/419 |
| 3,210,595 | 10/1965 | Hochheiser | 313/419 X |

*Primary Examiner*—Paul L. Gensler
*Assistant Examiner*—E. R. LaRoche
*Attorney, Agent, or Firm*—J. Carroll Baisch

[57] ABSTRACT

The present invention relates to apparatus for generating electric signals. Basically, the disclosed apparatus comprises a cathode-ray-type tube wherein the electron-beam sweeps across an especially designed electron-receptor. By suitable design of the receptor in conjunction with the beam-deflecting signal, the disclosed apparatus generates many desired output signals.

11 Claims, 16 Drawing Figures

CATHODE-RAY TUBE SIGNAL GENERATOR HAVING RESISTANCE CONFIGURATED ELECTRON RECEPTOR

BACKGROUND

In the electronics art, there is frequently a need for electric signals having specific variations with respect to time; and there are a number of different ways for "generating" such signals. Most such signal generators are all electronic circuitry; but all electronic-circuit signal generators have many inherent problems — especially in the generation of complex electric signals — these problems including circuit complexity; high cost; relative inefficiency — due to waveshaping, clipping, drift, etc.

OBJECTIVES AND DRAWINGS

It is, therefore, the principal objective of the present invention to provide an improved signal generator.

It is another objective of the present invention to provide an improved signal generator adapted to produce complex electric signals.

It is still another objective of the present invention to provide an improved signal generator by utilizing a cathode-ray-tube type of structure.

It is a further objective of the present invention to provide an improved signal generator adapted to function as an analog-to-digital converter.

It is a still further object of the present invention to provide an improved signal generator adapted to convert one electric signal to another form.

The attainment of these objectives and others will be realized from a study of the following specification, taken in conjunction with the drawings, of which:

SYNOPSIS

Broadly stated, the disclosed cathode-ray type tube comprises an electron receptor that is positioned so as to be impinged upon by the sweeping electron beam. The receptor is "resistance-configurated"; that is, it has a resistance characteristic that depends upon the point at which the electron beam impinges onto the electron receptor. The flow of electrons through the resistive receptor produces electric signals that vary in amplitude with the sweeping action of the electron beam. In this way, the disclosed signal generator is enabled to produce complex electric signals.

INTRODUCTION

The Cathode Ray Tube

Figure 1:
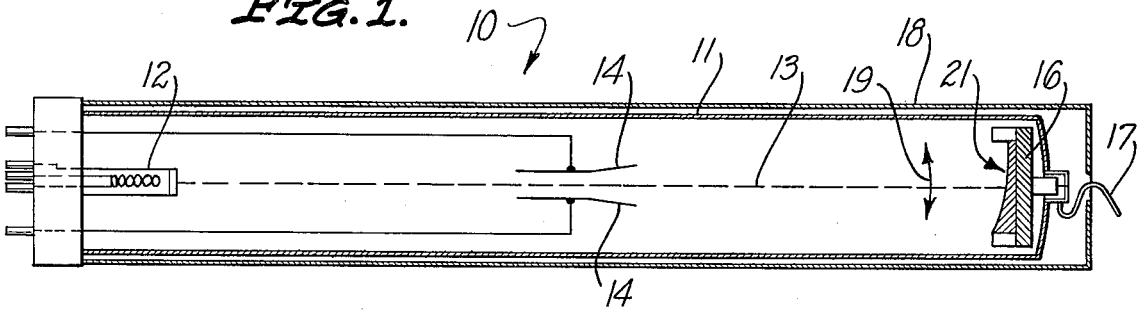
FIG. 1 shows a simplified over-all schematic representation of the subject signal generator.

In order to clarify the operation of the disclosed signal generator, it is desirable to first clarify the operation of a cathode ray tube; and FIG. 1 shows a schematic representation of the subject signal generator 10. Here, the signal generator 10 comprises an evacuated envelope or "tube" 11 (usually of glass) that has an "electron gun" 12 positioned at one end thereof, for producing a stream or a beam 13 of preferably collimated electrons. Electron guns and collimating means are well known to those skilled in the cathode-ray-tube art; these electron guns usually comprising a heated material for emitting electrons that are formed into the desired collimated electron beam by any of a number of collimating means — such as magnetic fields, electrostatic fields, ceramic ring magnets, and the like.

It is usually desirable, in a cathode-ray-tube, to move (or "deflect") the electron beam 13 in such a manner that it "sweeps" across a target; and this electron beam movement is usually produced by one or more (usually a pair) of "deflection elements", such as plates 14 to which a "deflection signal" is applied.

The deflecting — or sweeping — action of the electron beam 13 will be better understood when it is recalled that the electrons carry a negative electric charge; so that when a positive deflection signal is placed on one of the deflection plates 14, the electron beam 13 is attracted towards that deflection plate; and when a negative deflection signal is placed on one of the deflection plate, the electron beam 13 is repelled. Usually, a positive deflection-signal is placed on one deflection plate 14, and a negative deflection signal is simultaneously placed on the other deflection plate 14 — so that the two oppositely-poled deflection signals act in a "push-pull" manner to provide improved deflection of the electron beam 13.

As the deflection signals applied to the deflection plates 14 are changed in strength and in polarity, the electron beam is deflected in a corresponding manner; so that suitable deflection signals cause the electron beam 13 to sweep across a target located in the cathode-ray-tube.

In FIG. 1, the deflection plates 14 are such that they cause the electron beam 13 to sweep back and forth in a single plane; but many, in fact most, cathode-ray-tubes have an additional set of deflection plates to produce a sweeping action in a second — usually perpendicular — plane. Thus, by suitable choice of deflection plates and deflection signals, the electron beam 13 may be swept in a horizontal plane, in a vertical plane, or in a combination of planes that produce two-dimensional sweep patterns.

A "collector electrode" 16 coacts with the electron gun 12 to establish an electrostatic field that accelerates the electrons from the gun 12 to the collector 16; and the electrons flow out of the tube along a collector wire 17.

It is well known that if a high velocity electron beam is used, its impingement upon a target may cause the emission of "secondary electrons" that could inadvertently form part of the output signal. Since this is a well known phenomenon, there are a number of well known solutions that are used in conventional vacuum tubes. Therefore, secondary-emission electrons do not introduce any problem in the present invention.

Under certain conditions, it may be desirable to include various components (not shown) that improve the action of beam collimation; and to enclose the tube in a metal shield 18 for the purpose of protecting it from external electric and/or magnetic fields.

Electric Signals

One of the easiest electric signals to generate electronically is that known as a "sinusoidal", or "sine" waveform; so that sine-waveform generators are readily available. If such a sine waveform is applied as a deflection signal to the deflection plates 14 of FIG. 1, it causes the electron beam 13 to sweep cyclically back and forth — as indicated by the double-ended curved arrow 19.

Another type of electric signal is known as a "sawtooth" waveform; and this waveform has the advantage that, when used as a deflecting signal, it causes the electron beam to be deflected "linearly" with respect to time. This sawtooth waveform is somewhat more difficult to generate; and it will be shown later that the disclosed signal generator may be readily adapted to produce such a sawtooth waveform.

Other electric signals, or portions of the above, may at times be desired for special types of beam-deflection.

DISCLOSURE

The Electron Receptor (I)

As indicated in FIG. 1, the electrons that form the electron beam 13 traverse the length of the cathode-ray-tube, and impinge onto the front surface of an electron receptor 21. Here the electrons flow longitudinally through the receptor 21 to the previously described collector electrode 16, positioned contiguously with the back surface of the receptor and flow out of collector wire 17 — to form an electic output signal. The front surface/back-surface direction of the receptor defines the longitudinal direction, which conforms with the longitudinal direction of the cathode ray tube.

As will be discussed later, the number of electrons that flow through the electron receptor 21 varies; and these variations in the electron-flow produces a varying electron current that forms an output electric signal. For reasons that will become apparent later, the electron receptor 21 will be designated as being "resistance configurated."

Figure 2:
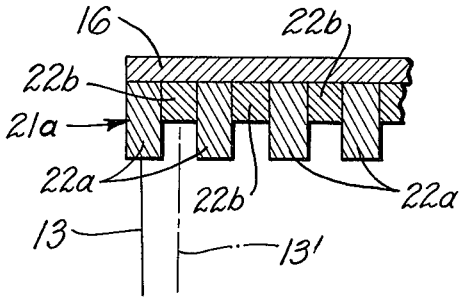
FIG. 2 shows a post-type electron receptor.

It will be recalled from the foregoing description — and from FIG. 1 — that the electron beam 13 sweeps across, and impinges on the electron receptor 21; and attention is now directed to FIG. 2, which illustrates an electron receptor **21*a* formed of two sets of insulated resistive posts 22*a* and 22*b*** of resistive material such as the compounds that are used for making composition resistors.

In FIG. 2, the solid-line representation of electron beam 13 is illustrated as impinging upon the front surface of a long resistive post **22*a*; so that the electrons flowing through post 22*a* to collector 16** encounter an appreciably high electric resistance path — to form a low-amplitude output electric current.

Under the influence of the deflection system discussed above, the electron beam may be deflected to the position indicated by the dotted line representation 13' of the electron beam in FIG. 2. Now the electrons impinge upon the front surface of a short resistive post **22*b*; so that the electrons flowing longitudinally through the short resistive post 22*b*** encounter a smaller electric resistance path — to form a larger amplitude output current.

It will be noted that the value of the instantaneous resistive path depends upon the point of impingement of the electron beam 13 on the target 21 that is, the front-to-collector electric resistance of the target varies along the area presented to the electron beam, thus forming a resistance-configurated receptor.

Thus, as the electron beam 13 sweeps across the resistance configurated receptor **21*a* of FIG. 2, the electron beam 13 alternately impinges onto the front surfaces of long and short resistive posts 22*a* and 22*b*. The resistance configuration formed by posts 22 causes the resultant output signal to vary as indicated at 23 of FIG. 3**, to generate a "square" waveform electric signal.

Figure 3:
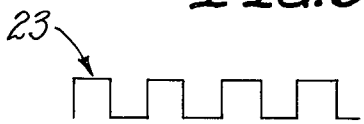
FIG. 3 shows one type of electric signal that may be generated by the electron receptor of FIG. 2.

Alternatively, it may be desirable that the resistive posts **22*a* and 22*b* be of the same length; and, in this case, the same output waveform 23 of FIG. 3** may be achieved by forming one set of the resistive posts of a different material — and thus of a different resistance — than the other set.

It will be realized that by using a deflecting signal of suitable frequency, the output signal 23 of FIG. 3 may have any desired repetition rate. Moreover — by suitably pre-determining the length and number of the resistive posts **22*a* and 22*b*, the strength of the electron beam 13, and other factors of the cathode-ray-tube — the amplitude of the output signal 23** may be made as large or as small as desired, or may have unequal pulses. In some cases, the characteristics of the desired output signal and/or of the deflecting signal, may require that the diameters or other cross sections of the receptor posts may have to differ from each other for extremely precise or special outputs. In this way, the disclosed signal generator may generate a relatively complex square waveform, rectangular waveform, or the like.

It may be understood that the receptor is resistance configurated to provide different and diverse-valued resistance paths for the electrons as they traverse the receptor, and flow toward the collector electrode 16.

The Electron Receptor (II)

As pointed out above, there is frequently a need for a sawtooth waveform; and this waveform is usually generated electronically by repeated amplifying and clipping a sinusoidal waveform, by charging a capacitor, or by other relatively complex techniques.

Figure 4:
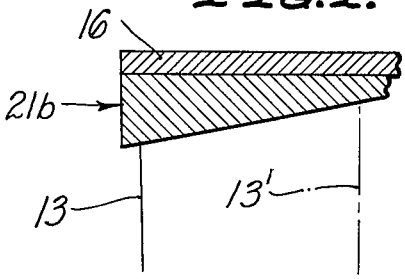
FIG. 4 shows a volumetric type of electron receptor.

Such a sawtooth waveform is readily generated by the subject invention as follows. Referring now to FIG. 4, it will be seen that in this case, the receptor **21*b* takes the form of a volumetric wedge of resistive material. When the electron beam 13 impinges as indicated by the solid-line representation of FIG. 4, the electrons flow longitudinally from the point of impingement to the collector electrode 16**; and the high electric resistance between the impingement point of the receptor 21*b* and the collector 16 provides a low-amplitude output current; whereas, when the electron beam 13′ is deflected to impinge as indicated by the dotted line 13′, the low electrical resistance between the impinged portion of the receptor 21*b* and the collector 16 provides a high amplitude output current.

Figure 5:
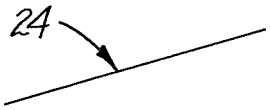
FIG. 5 shows one type of electric signal that may be generated by the receptor of FIG. 4.

Thus, the resistance configurated volumetric receptor 21*b* provides different and diverse valued resistive paths for the electron flow as the electrons traverse the receptor, and flow to the collector. In this way, the resistance configurated receptor 21*b* causes the disclosed signal generator to produce a relatively complex ramp-type output sawtooth signal indicated at 24 of FIG. 5.

Here too, it will be noted that the value of the front-to-back resistive paths between the point of electron impingement and the collector 16 depends upon the point of impingement and the resistive configuration of the electron receptor. Because of the use of the volumetric wedge, rather than the use of insulated posts, it is possible to continuously vary the resistance configuration of the receptor 21*b* in order to obtain a precise linear signal 24.

Figure 6:
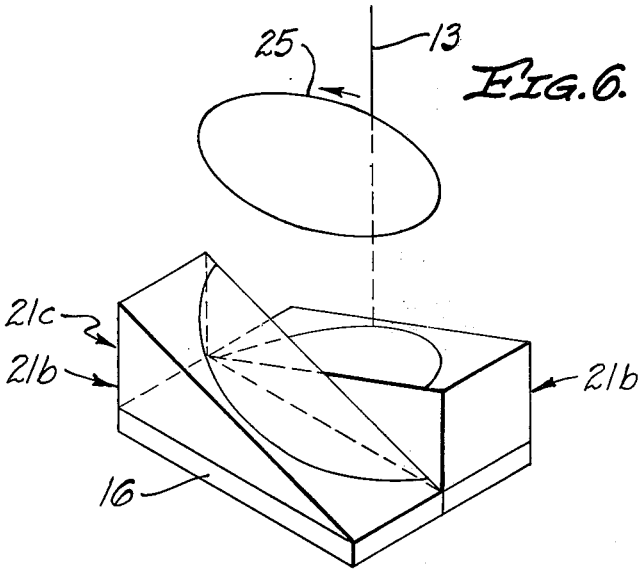
FIG. 6 shows an opposed complementary type electron receptor.

FIG. 6 shows an electron receptor 21*c* that may be used for producing a repetitive ramp-type signal; the composite electron receptor 21*c* comprising two oppositely sloping but similar electron receptors 21*b* in an opposed complementary relationship. The electron beam 13 is deflected in an elliptical path 25 — as by means of a second pair of deflection plates, as discussed above.

Figure 7:
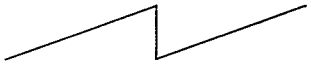
FIG. 7 shows one type of electric output signal that may be generated by the receptor of FIG. 6.

The resultant output waveform of the resistance configurated electron receptor 21*c* is indicated in FIG. 7.

The Electron Receptor (III)

Figure 8:
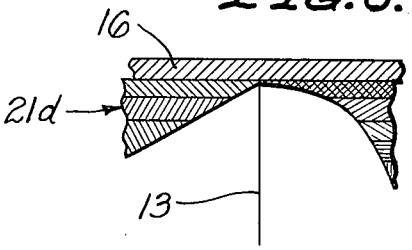
FIG. 8 shows a multi-layer type of electron receptor.

FIG. 8 shows another receptor 21*d;* and here the electron beam 13 is normally positioned at the center of the receptor 21*d*, as by suitably biasing the deflection system. A more positive deflection signal moves the electron beam 13 in one direction; whereas a less-positive (or negative) deflection signal moves the electron beam 13 in the opposite direction.

As indicated in FIG. 8, the receptor 21*d* is illustrated to be composed of layers of different valued resistive material; and if desired, the receptor 21*d* may be non-symmetrical. Here too, the resistive configuration provides different and diverse-valued resistive paths for the electrons as they flow through the receptor 21*d* to the collector 16; the front-to-back resistive values depending upon the point of impingement of the electron beam onto the receptor.

Figure 9:
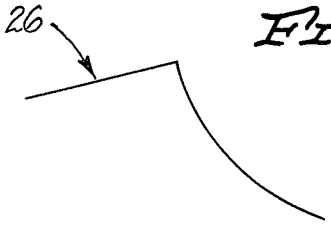
FIG. 9 shows one type of electric signal that may be generated by the electron receptor of FIG. 8.

A typical complex output signal 26 of this multi-layered resistance configurated receptor as established by the various layers and deflection of electron beam 13, is indicated in FIG. 9.

The Electron Receptor (IV)

It has been pointed out that the present invention uses the concept of a resistance configurated receptor that may take any of a number of forms. Another form of the receptor may utilize thin film techniques, it being known that thin films of desired resistance may be formed on a desired surface.

Figure 10:
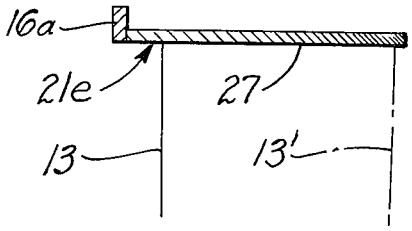
FIG. 10 shows a thin-film type of electron receptor.

FIG. 10 shows a receptor 21*e* using a thin resistive film 27 that has its resistance varied across the width thereof. When the electron beam 13 impinges near one edge of the film 27 — as indicated by the solid line representation, 13 the electrons flow transversely relative to the longitudinal direction of the target through the thin film 27 to the collector 16*a;* and the low transverse electrical resistance of the film 27 produces a high amplitude output signal, whereas when the electron beam impinges near the other edge of the film 27, as indicated by the dotted line —13′— the high transverse electrical resistance of the film 27 produces a low amplitude output signal. Thus, the front-surface-to-collector electric resistance of the receptor also varies along the area presented to the electron beam.

Figure 11:
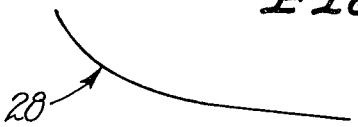
FIG. 11 shows one type of electric signal that may be generated by the electron receptor of FIG. 10.

A typical output current waveform is shown at 28 of FIG. 11; but it may obviously take a much more complex form.

The Electron Receptor (V)

Figure 12:
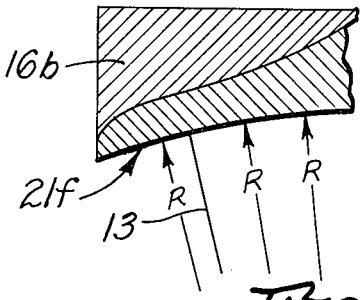
FIG. 12 shows a type of electron receptor having all points of its front surface substantially equi-distant from the electron gun.

Under some conditions, it may be desirable that the electron receptor provide an impingement surface substantially equi-distant from the electron gun; and this result may be achieved by the type of receptor 21*f* shown in FIG. 12. Here, the receptor 21*f* is volumetrically configurated in such a manner that it has desired resistance paths while still providing an equi-distant front surface to the source of the impinging electron beam 13 — as indicated by the radii "R". The back-surface collector 16*b* may be correspondingly configurated to produce a flat rear surface, where this is desired.

Figure 13:
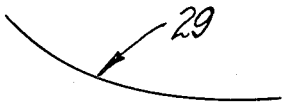
FIG. 13 shows one type of electric signal that may be generated by the electron receptor of FIG. 12.

A typical simplified output waveform is indicated at 29 of FIG. 13.

The Electron Receptor (VI)

Figure 14:
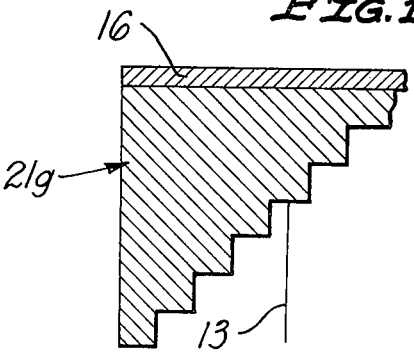
FIG. 14 shows a stepped volumetric electron receptor.
Figure 15:
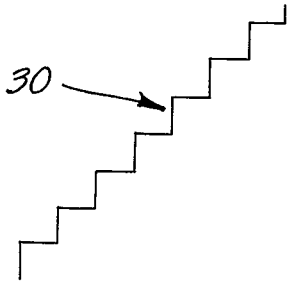
FIG. 15 shows one type of electric signal that may be generated by the electron receptor of FIG. 14.

There are times when a "staircase waveform" is desired; and the present invention generates such a waveform by using a receptor configuration 21*g* illustrated in FIG. 14. As the electron beam 13 sweeps across the receptor 21*g*, the resistance configuration thereof produces resistive paths that generate the complex staircase waveform 30 illustrated in FIG. 15.

This same receptor 21*g*, or a modification thereof, may be used to convert an input "analog" signal to an output "digital" signal; that is, when the input signal varies in amplitude — and thus selectively positions the electron beam 13 — the output signal varies in a correspondingly step-like manner that is characteristic of a digital representation. Alternatively, the input deflection signal may be of the digital step-like type; and a suitably resistance configurated receptor may produce analog output signals.

Additional Uses

In electronic circuitry, there are many times when a plurality of signals are required; with the additional requirement that the various signals be synchronized. In the past, this has required circuitry that included timing and synchronizing signals — and these have usually produced additional circuit complications.

Figure 16:
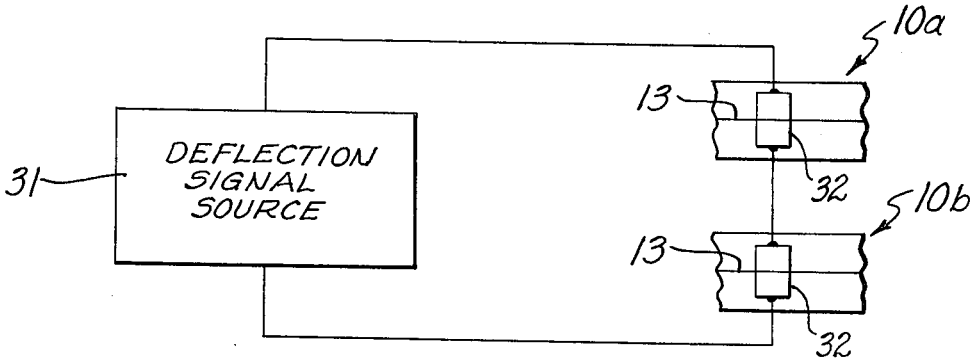
FIG. 16 shows two of the disclosed signal generators connected in a push-pull arrangement for generating synchronized electric signals.

The partial illustration of FIG. 16 shows how the subject invention solves this problem of generating synchronized signals. Here, two of the disclosed signal generators 10*a* and 10*b* are connected in the well known "push-pull" arrangement. In this circuit, operating power is applied to the two signal generators 10*a* and 10*b* in the well known manner; and the deflection electrodes, indicated to be magnetic deflection coils 32, of the separate signal generators 10*a* and 10*b* are connected to opposite sides of a deflection signal source 31. Thus, electron beams 13 of the two signal generators 10*a* and 10*b* are activated simultaneously, by the same deflection signal; so that the output signals of the signal generators 10*a* and 10*b* are synchronized — even though their separate output signals may be entirely different from each other, due to the use of different electron receptor configurations.

It should be noted that the disclosed push-pull arrangement does not require a phase splitter for its operation.

The disclosed signal generator may also be used as a "mixer", by applying different input signals to the separate deflection electrodes. Referring back to FIG. 1, it will be noted that when the two input signals are of opposite polarity, each acts to deflect the electron beam in the same direction — thus adding their instantaneous values. On the other hand, when both of the input signals are of the same polarity, each acts to deflect the electron beam in the opposite direction — thus subtracting, or "mixing" their instantaneous values.

As a result of this signal mixing, the instataneous position of the electron beam 13 corresponds with the instantaneous values of the two input signals; and the receptor 21 thus produces an output signal in accordance with the instantaneous input signals, and with its resistive configuration.

It is well known that "switching" signals are frequently desired; that is, the signal should have two levels — one of which may represent an ON state and the other of which may represent an OFF state. A resistive configuration similar to that of FIG. 2 (or of FIG. 14) may be used to generate multi-level switching signals.

When the electron beam 13 is in the illustrated solid-line position of FIG. 2, one signal level is produced; whereas when the electron beam is in the illustrated dotted-line position, 13' another signal level is produced — this two post configuration corresponding to a single-pole single-throw switch.

By using three adjacent posts, the apparatus acts as a single-pole, double-throw switch; and the neutral position may be selected to be ON or OFF by selecting the proper combination of resistive posts, or by selecting the proper neutral position of the electron beam.

By using five adjacent posts arranged in the form of a plus sign, and by using a second pair of deflection plates, the electron beam may be positioned to impinge onto any of the five posts. Thus, the present invention may serve as a single-pole four-throw switch. Other more complex switching arrangements are also possible.

While the foregoing discussion has been presented in terms of relatively simple electric signals, it is obvious that by suitable design of the resistance configuration of the electron receptor and of the deflecting signals, more complex electric signals may be generated.

As indicated above, the electron beam may be caused to vary in a one-dimensional pattern by the use of suitable deflection plates and signals; but more complex output signals may be generated by using a two-dimensional resistive configurated receptor and suitable deflection plates and signals.

It was pointed out above that the present invention can generate a wide variety of output signals by using suitable deflection signals and resistance configurated electron receptors. It should also be noted that the disclosed signal generator may be designed in such a way that its output signal is an amplified version of its deflection, or input, signal.

This amplifier effect is achieved as follows. Referring back to the types of electron receptors of FIGS. 4, 8, 10 and 12, it is apparent that the disclosed signal generator may be designed in such a way that the electron beam is normally positioned at the center portion of the electron receptor. If now, the electron beam is deflected in one direction (say to the right), the amplitude of the output signal will be varied (say increased); whereas if the electron beam is deflected in the opposite direction, the amplitude of the output signal will be decreased. Therefore, if the deflection signal were a sine-wave-form that causes the electron beam to oscillate cyclically, the output signal increases and decreases cyclically; and the resistance configuration of the electron receptor may be such that the output signal is also a sine-waveform. Moreover, by suitable selection of the strength of the electron beam and of the actual resistance of the electron receptor, the sine-waveform output signal may be made much larger than the input signal. Suitable resistance gradients of the electron receptor assure that the output signal has the desired proportions.

Similarly, if the deflection signal were a square waveform, the output signal may be an amplified square wave. In a like manner, the disclosed signal-generator may amplify other input signals.

SUMMARY

The present invention has many advantages over prior-art signal generators.

First of all, it is relatively simple.

It does not vary or age with time.

It produces constant and consistent results.

It may be quite small and compact.

It requires only very simple electric signals for its operation.

It requires minimal or no maintenance.

It uses simple well known principles.

It is long lived.

And, finally, it generates electric signals that may be quite complex.

I claim:

1. In combination with a cathode-ray tube having means for producing an electron beam, means for deflecting said electron beam, and a collector electrode for collecting the electrons of said electron beam, the improvement comprising:

a resistance configurated electron receptor positioned to be impinged upon by said electron beam as said electron beam is deflected by said deflection means;

the resistance of said resistance-configurated electron-receptor varying longitudinally along the area presented to the electron beam, being adapted to produce an output signal corresponding to a desired waveform;

said electron-receptor being a unitary structure of resistive material, having a front surface onto which said electron beam impinges, and having a back surface;

the front-surface/back-surface direction defining the longitudinal direction of said electron-receptor;

the entire back-surface of said electron-receptor being in electrical contact with said collector-electrode.

2. The invention of claim 1, wherein said resistance-configurated receptor comprises resistive material configurated to provide a plurality of resistive paths for electrons resulting from said electron beam as said electrons traverse said receptor, and flow longitudinally to said back surface.

3. The invention of claim 2, wherein the front-to-back values of said resistive paths varies along the area of impingement of said deflected electron beam on said receptor, and the electrons resulting from said electron-beam leave said electron receptor at said back surface.

4. The invention of claim 3, wherein said resistive configuration of said receptor provides diverse resistive paths in said longitudinal direction.

5. The invention of claim 3, wherein said resistive configuration comprises a plurality of electrically resistive posts.

6. The invention of claim 3, wherein said resistive configuration electron-receptor comprises a multilayer resistive configuration.

7. The invention of claim 3, wherein said resistive configuration electron-receptor comprises a front surface that is struck by said electron beam, said front surface having a curvature placing all areas of said front surface substantially equi-distant from said electron beam producing means;

said front-to-back resistive values varying to compensate for said curvature.

8. The invention of claim 3, wherein said resistive configuration electron-receptor comprises a stepped volumetric arrangement of resistive material.

9. The invention of claim 3, wherein said resistive configuration electron-receptor comprises a volumetric arrangement of resistive material.

10. The invention of claim 9, wherein said resistive configuration comprises a volumetric wedge-like arrangement of resistive material, said wedge-like arrangement having a front surface onto which said electron-beam impinges, and having a back surface from which the electrons of said electron-beam leave said electron-receptor.

11. The invention of claim 9, wherein said resistive configuration comprises two similar volumetric wedge-like arrangements of resistive material positioned in an opposed complementary relationship, each of said wedge-like arrangements having a front surface onto which said electron-beam impinges, and having a back surface from which the electrons of said electron-beam leave said electron-receptor.

* * * * *